US006712716B2

(12) United States Patent
Halko

(10) Patent No.: US 6,712,716 B2
(45) **Date of Patent: *Mar. 30, 2004**

(54) MULTILAYER GOLF BALL WITH WOUND INTERMEDIATE LAYER

(75) Inventor: Roman D. Halko, Chula Vista, CA (US)

(73) Assignee: Acushnet Company, Fairhaven, MA (US)

( * ) Notice: Subject to any disclaimer, the term of this patent is extended or adjusted under 35 U.S.C. 154(b) by 155 days.

This patent is subject to a terminal disclaimer.

(21) Appl. No.: 09/923,390

(22) Filed: Aug. 8, 2001

(65) Prior Publication Data

US 2002/0055398 A1 May 9, 2002

Related U.S. Application Data

(63) Continuation-in-part of application No. 09/497,503, filed on Feb. 4, 2000, which is a continuation-in-part of application No. 09/266,847, filed on Mar. 12, 1999, now Pat. No. 6,149,535.

(51) Int. Cl.[7] ..... A63B 37/06
(52) U.S. Cl. ..... 473/362; 473/357
(58) Field of Search ..... 473/351–377

(56) References Cited

U.S. PATENT DOCUMENTS

| | | | | |
|---|---|---|---|---|
| 972,313 | A | 10/1910 | Worthington | |
| 1,622,601 | A | 3/1927 | Miller | |
| 3,119,622 | A | 1/1964 | Weigert | |
| 3,134,598 | A | 5/1964 | Muccino | |
| 3,616,101 | A | 10/1971 | Satchell et al. | |
| 4,272,079 | A | 6/1981 | Nakade et al. | |
| 4,469,739 | A | 9/1984 | Gretzinger et al. | |
| 4,473,229 | A | 9/1984 | Kloppenburg et al. | |
| 4,572,507 | A | 2/1986 | Hubbert et al. | |
| 4,783,078 | A | 11/1988 | Brown et al. | |
| 5,006,297 | A | 4/1991 | Brown et al. | |
| 5,020,803 | A | 6/1991 | Gendreau et al. | |
| 5,201,523 | A | 4/1993 | Miller | |
| 5,334,673 | A | 8/1994 | Wu | |
| 5,484,870 | A | 1/1996 | Wu | |
| 5,674,137 | A | 10/1997 | Maruko et al. | 473/354 |
| 5,679,196 | A | 10/1997 | Wilhelm et al. | 156/167 |
| 5,683,312 | A | 11/1997 | Boehm et al. | 473/354 |
| 5,685,785 | A | 11/1997 | Kakiuchi et al. | 473/354 |
| 5,713,801 | A | 2/1998 | Aoyama | 473/354 |

(List continued on next page.)

FOREIGN PATENT DOCUMENTS

| | | |
|---|---|---|
| DE | 1428816 | 4/1969 |
| GB | 1021424 | 3/1966 |
| GB | 1321269 | 6/1973 |
| GB | 1321270 | 6/1973 |

*Primary Examiner*—Paul T. Sewell
*Assistant Examiner*—Alvin A. Hunter
(74) *Attorney, Agent, or Firm*—Swidler Berlin Shereff Friedman, LLP

(57) ABSTRACT

The present invention describes a golf ball with a center, at least one wound layer, optionally, at least one intermediate layer, and at least one cover layer. The center is at least about 1 inch in diameter and includes polybutadiene, natural rubber, polyisoprene, styrene-butadiene, or styrene-propylene-diene rubber. The at least one wound layer includes one or more of polyether urea, polyester urea, polyester block copolymers, polyethylene, polyamide, polyketon, poly (p-phenylene terephthalamide), or polyisoprene. The at least one intermediate layer includes polybutadiene, natural rubber, polyisoprene, styrene-butadiene, or styrene-propylene-diene rubber. The at least one cover layer includes a thermoplastic resin or a thermoset material. This unique construction gives the ball characteristics both of a wound and a solid construction.

36 Claims, 5 Drawing Sheets

U.S. PATENT DOCUMENTS

| | | | | | |
|---|---|---|---|---|---|
| 5,733,428 | A | | 3/1998 | Calabria et al. | 264/134 |
| 5,749,796 | A | | 5/1998 | Shimosaka et al. | 473/365 |
| 5,759,676 | A | | 6/1998 | Cavallaro et al. | 428/215 |
| 5,772,530 | A | | 6/1998 | Kato | 473/363 |
| 5,813,923 | A | | 9/1998 | Cavallaro et al. | 473/373 |
| 5,816,939 | A | | 10/1998 | Hamada et al. | 473/357 |
| 5,816,940 | A | | 10/1998 | Hayashi et al. | 473/359 |
| 5,823,890 | A | | 10/1998 | Maruko et al. | 473/354 |
| 5,885,172 | A | * | 3/1999 | Hebert et al. | 473/354 |
| 5,888,157 | A | | 3/1999 | Guenther et al. | 473/604 |
| 5,962,140 | A | | 10/1999 | Rajagopalan | 428/421 |
| 5,993,968 | A | | 11/1999 | Umezawa et al. | 428/407 |
| 6,054,550 | A | | 4/2000 | Umezawa et al. | 528/76 |
| 6,095,932 | A | | 8/2000 | Umezawa et al. | 473/356 |
| 6,113,505 | A | * | 9/2000 | Boehm | 156/186 |
| 6,135,899 | A | | 10/2000 | Maruko | 473/376 |
| 6,149,535 | A | | 11/2000 | Bissonnette et al. | 473/354 |

* cited by examiner

MULTILAYER GOLF BALL WITH WOUND INTERMEDIATE LAYER

CROSS-REFERENCE TO RELATED APPLICATIONS

This application is a continuation-in-part of application Ser. No. 09/497,503 filed Feb. 4, 2000, now pending, which is a continuation-in-part of application Ser. No. 09/266,847, now U.S. Pat. No. 6,149,535, filed Mar. 12, 1999, the contents of which are incorporated herein by express reference thereto.

FIELD OF INVENTION

This invention relates generally to golf balls including a core having at least one wound layer and a cover disposed thereabout, and more particularly to wound golf balls having a wound thread layer between rubber-based layers.

BACKGROUND OF THE INVENTION

Conventional golf balls can be divided into two general types of groups: solid balls or wound balls. The difference in play characteristics resulting from these different types of construction can be quite significant. Balls having a solid construction are generally most popular with the average recreational golfer because they provide a very durable ball while also providing maximum distance. Solid balls are generally made with a single solid core, which is enclosed by a cover material. Typically the solid core is made of polybutadiene which is chemically crosslinked with zinc diacrylate and/or similar crosslinking agents. The cover is generally a material such as SURLYN®, which is a trademark for an ionomer resin produced by DuPont. Because these materials are very rigid, solid balls can have a hard "feel" when struck with a club. Likewise, due to their construction, these balls have a relatively low spin rate which provides greater distance.

At the present time, the wound ball provides the advanced player better spin and feel characteristics. Wound balls typically have either a spherical solid rubber or liquid center core around which many yards of a tensioned elastic thread are wound. The wound core is then covered with a durable cover material, such as a SURLYN® or similar material, or a softer cover such as Balata or polyurethane. Wound balls are generally softer and provide more spin, which enables a skilled golfer to have more control over the ball's flight and position. Particularly, with approach shots onto the green, the high spin rate of soft, wound balls enable the golfer to stop the ball very near its landing position.

Regardless of ball construction, players generally seek a golf ball that maximizes total game performance for their requirements. Therefore, in an effort to meet the demands of the marketplace, manufacturers strive to produce golf balls with a wide variety of performance characteristics to meet the players individual requirements. Thus, golf ball manufacturers are continually searching for new ways in which to provide golf balls that deliver the maximum performance for golfers of all skill levels.

To meet the needs of golfers with various levels of skill, golf ball manufacturers are also concerned with varying the level of the compression of the ball, which is a relative measurement of the golf ball stiffness under a fixed load. A ball with a higher compression feels harder than a ball of lower compression. Wound golf balls generally have a lower compression which is preferred by better players. Whether wound or solid, golf balls typically become more resilient (i.e., have higher initial velocities) as compression increases. Manufacturers of both wound and solid construction golf balls must balance the requirement of higher initial velocity resulting from a higher compression with the desire for a softer feel from lower compression.

To make wound golf balls, manufacturers use winding machines to stretch the threads to various degrees of elongation during the winding process without subjecting the threads to unnecessary incidents of breakage. Generally, as the elongation and winding tension increase, the compression and initial velocity of the ball increase. Thus, a more resilient wound ball is produced, which is desirable.

Referring to FIG. 1, a conventional golf ball thread 10 is shown. In general, a single-ply golf ball thread or two-ply thread 10 is formed and wound around a center. Single-ply threads are generally made using a liquid latex that is cast into a sheet and then slit into threads having a generally rectangular or square cross-section. Two-ply threads are generally made by mixing synthetic cis-polyisoprene rubbers, natural rubber and a curing system together, calendering this mixture into two sheets, calendering the sheets together, curing the sheets to vulcanize and bond the sheets together, and slitting the resultant sheet into threads having a generally rectangular or square cross-section. Another method of forming threads is through an extrusion process. Extruded thread, however, has not previously been used in golf ball applications. An example of an extruded thread that is not used in golf balls is disclosed in U.S. Pat. No. 5,679,196 to Wilhelm et al. This patent discloses a thread formed from a mixture having more than 50 percent natural rubber.

A number of different windings have been disclosed for use in golf balls. U.S. Pat. No. 4,473,229 to Kloppenburg et al. discloses a golf ball having a core formed of graphite fibers and windings made of graphite filaments and resins. Yarns are made with the graphite filaments and resins, and as many as four or more yarns are combined to form a final yarn used for winding. U.S. Pat. No. 5,713,801 to Aoyama discloses the use of a layer of high tensile elastic modulus fibers wound about the core. The fibers have a tensile elastic modulus of at least 10,000 kpsi. Also, U.S. Pat. No. 5,816,939 to Hamada et al. discloses a rubber thread for winding with a tensile strength retention of up to 70 percent, a hysteresis loss of at least 50 percent, and an elongation of 900 percent to 1400 percent.

Prior art wound golf balls and cores typically use polyisoprene rubber thread. The polyisoprene thread is wound onto the cores at elongations between 500 percent to 1000 percent. The amount of thread required for a golf ball core is dependent on the elastic modulus of the thread in the elongated state. Elongated polyisoprene thread has an elastic modulus between 10,000 psi and 20,000 psi. Further, the properties, in particular resilience, of the wound ball or core are dependent on how well the thread packs during winding. The dimensions of the thread control the packing density. Polyisoprene threads are typically 0.0625 inches wide by 0.02 inches thick, measured prior to winding. However, present art polyisoprene thread is commonly produced in thicknesses between 0.014 inches and 0.024 inches.

There are some drawbacks to the conventional single-ply threads used in golf balls. The single-ply occasionally contains weak points. As a result, manufacturers of wound balls do not wind using the maximum tension or stretch the thread to the maximum elongation, because to do so would cause an excessive amount of breakage during winding. When a thread breaks during manufacturing, an operator must restart the operation. This decreases production, and is thus undesirable. The use of two-ply threads in golf balls reduces but does not eliminate this problem.

The thread can also break during play due to impact of a club with the ball. These breaks can result in various consequences. Cover material is disposed around the thread portions adjacent the cover. When the thread portions adjacent the cover break, the cover material tends to hold these thread portions in the proper position. If enough thread portions break near the cover, however, a lump will be created on the outside surface of the ball, which makes the ball unplayable.

More severe problems can occur, however, when thread portions near the center break. In a wound ball with a solid rubber center, the resilient rubber of the center is relatively soft compared to the hardness of the highly stretched thread portions. After a thread portion adjacent the center breaks, the thread portion can contract and cause a loss of compression and resiliency. This results in an undesirable distance loss.

In a wound ball with a fluid-filled center, after a thread portion adjacent the center breaks, the resultant imbalance in stress adjacent the center causes the thread to cut through the envelope that contains the fluid. This destroys the structural integrity of the ball and makes it unplayable. If this type of failure happens during a shot, it can result in a short shot. It can also result in the ball deviating from its line of flight as it leaves the club, so that the ball can end up off of the fairway. Both of these consequences are undesirable.

Therefore, golf ball manufacturers are continually searching for new ways in which to provide wound golf balls that deliver the maximum performance for golfers while decreasing the occurrence of thread breaks both during manufacturing and during play. It would be advantageous to provide a wound golf ball with a lower compression, higher initial velocity, more dense packing, improved durability, and improved manufacturing processibility. The present invention provides such a wound golf ball.

SUMMARY OF THE INVENTION

The invention relates to a golf ball including a solid center, at least one wound thread layer disposed about the center, an intermediate layer including at least one thermoset material disposed about the wound layer, and a cover of at least one layer. In one embodiment, the wound thread layer is made of material selected from the group consisting of polyethylene, polyamide, polyketon, poly(p-phenylene terephthalamide), or polyisoprene. In another embodiment, the center has a diameter of at least about 1 inch, preferably about 1 inch to about 1.55 inches.

In another embodiment, the thread is wound at elongations of at least about 100 percent, preferably at least about 200 percent. In another embodiment, the thread has a wound elastic modulus of about 20,000 psi to about 50,000 psi. In still another embodiment, the thickness of the wound layer is less than about 0.2 inches. In yet another embodiment, the center includes polybutadiene, natural rubber, polyisoprene, styrene-butadiene, or styrene-propylene-diene rubber. In another embodiment, the at least one intermediate layer has a thickness of less than about 0.15 inches. Preferably, is made of thermoset material including at least one of polybutadiene, natural rubber, polyisoprene, styrene-butadiene, or styrene-propylene-diene rubber. More preferably, the intermediate material further includes trans-polyisoprene, trans-polybutadiene, or a mixture thereof.

The invention also relates to a golf ball including a center having a diameter of at least about 1 inch, a polymer thread wound about the center, wherein the thread includes at least one polyether urea, polyester urea, polyester block copolymers, polyethylene, polyamide, polyketon, poly(p-phenylene terephthalamide), or polyisoprene, an intermediate thermoset layer, and a cover.

In one embodiment, the thread is wound at elongations of at least about 100 percent, preferably at least about 200 percent. In one embodiment, the thread has a wound elastic modulus of about 5,000 psi to about 50,000 psi. In yet another embodiment, the diameter of the center is about 1 inch to about 1.55 inches. In a preferred embodiment, the center includes at least one of polybutadiene, natural rubber, polyisoprene, styrene-butadiene, or styrene-propylene-diene rubber.

In another embodiment, the wound thread layer including strands having cross-sectional areas less than about 0.001 $in^2$, preferably less than about 0.0001 $in^2$.

The present invention also relates to a golf ball including a solid center, at least one wound thread layer disposed about the center, wherein the thread is wound at an elongation of at least 100 percent or greater, preferably 200 percent or greater and includes a plurality of individual strands, an intermediate layer disposed about the at least one wound thread layer, and a cover.

In one embodiment, the at least one wound thread layer is formed from a material including polyether urea, polyester urea, polyester block copolymers, polyethylene, polyamide, polyketon, poly(p-phenylene terephthalamide), or polyisoprene. The thread preferably includes about 10 individual strands or greater. In another embodiment, the thread includes about 50 individual strands or greater.

The wound thread preferably has an elastic modulus of about 20,000 psi to about 50,000 psi. In one embodiment, the thickness of the at least one wound thread layer is about 0.2 inches or less.

In one embodiment, the golf ball includes an additional thread layer disposed about the at least one wound thread layer, wherein the additional thread layer includes a single-ply or a two-ply thread.

The intermediate layer preferably includes at least one thermoset material. The at least one thermoset material may include at least one of polybutadiene, natural rubber, polyisoprene, styrene-butadiene, or styrene-propylene-diene rubber. In one embodiment, the at least one thermoset material includes trans-polyisoprene, trans-polybutadiene, or mixtures thereof.

The solid center may include at least one of polybutadiene, natural rubber, polyisoprene, styrene-butadiene, or styrene-propylene-diene rubber, and preferably has a diameter from about 1 inch to about 1.55 inches.

In one embodiment, the cover layer includes at least one of a castable reactive liquid material, thermoset urethane ionomer, thermoset urethane epoxy, or a mixture thereof. The castable reactive liquid material is preferably a thermoset material, more preferably a thermoset cast polyurethane.

The present invention also relates to golf ball including a center, a polymer thread wound layer about the center, wherein the thread includes about 10 individual strands or greater, an intermediate layer disposed about the polymer thread wound layer, wherein the intermediate layer has a thickness of about 0.15 inches or less, and a cover.

The polymer thread may include at least one of polyether urea, polyester urea, polyester block copolymers, polyethylene, polyamide, polyketon, poly(p-phenylene terephthalamide), or polyisoprene. In one embodiment, the polymer thread is wound at an elongation of at least about 100 percent. In another embodiment, the wound polymer thread has an elastic modulus of about 20,000 psi to about 50,000 psi. The cross-sectional area of the polymer thread is preferably about 0.001 $in^2$ or less, more preferably about 0.00001 $in^2$ or less.

The intermediate layer and center preferably includes at least one of polybutadiene, natural rubber, polyisoprene, styrene-butadiene, or styrene-propylene-diene rubber. In one embodiment, the center has a diameter of about 1 inch to about 1.55 inches.

In another embodiment, the cover layer includes an inner cover layer and an outer cover layer, preferably wherein the inner cover layer is formed of a material having a flexural modulus of about 65,000 psi or greater and the outer cover layer includes at least one castable reactive liquid material.

The present invention is also related to a golf ball including a center, a wound thread layer disposed about the center, wherein the thread includes at least one polyether urea, polyester urea, polyester block copolymers, polyethylene, polyamide, polyketon, poly(p-phenylene terephthalamide), or polyisoprene, an intermediate layer disposed about the wound thread layer, and a cover disposed about the intermediate layer.

In one embodiment, the wound thread layer includes strands having cross-sectional areas of less than about 0.001 $in^2$. In another embodiment, the thread is wound at an elongation of at least about 100 percent, has an elastic modulus in the wound state of about 20,000 psi to about 50,000 psi, or both.

The center and the intermediate layer preferably include at least one of polybutadiene, natural rubber, polyisoprene, styrene-butadiene, styrene-propylene-diene rubber, or mixtures thereof.

In one embodiment, the diameter of the center is about 1.2 inches to about 1.55 inches and the intermediate layer has a thickness of about 0.15 inches or less.

In one embodiment, the cover includes an inner cover layer including at least one material having a flexural modulus of about 65,000 psi or greater, preferably about 70,000 psi to about 120,000 psi and an outer cover layer disposed about the inner cover layer including at least one castable reactive liquid material, preferably a thermoset cast polyurethane. The at least one material of the inner cover layer preferably includes an ionomer resin having a methacrylic acid content of about 19 percent. The at least one castable reactive liquid material of the outer cover layer preferably has a hardness of about 30 Shore D to about 60 Shore D and a thickness of about 0.05 inches or less.

BRIEF DESCRIPTION OF THE DRAWINGS

Further features and advantages of the present invention can be ascertained from the following detailed description that is provided in connection with the drawings described below.

DESCRIPTION OF THE INVENTION

The present invention is directed to wound single and multilayer golf ball cores and golf balls having threads that pack densely during winding. The materials used in the various layers may be altered to produce golf balls with a variety of performance and feel characteristics. Generally, the prior art has been directed to making golf balls and cores using single strand polyisoprene thread. The resilience and other properties of the golf ball are dependent on how well the thread packs during winding. The threads of the present invention advantageously have a smaller cross-sectional area, are composed of many strands, and have a higher than typical modulus of elasticity. The higher modulus of elasticity allows less thread to be used during the winding process.

The present invention is also directed to a golf ball that includes a larger than conventional center over which the thread is wound. The smaller dimensioned thread with a higher modulus of elasticity causes less air pockets during winding. The thread is more densely packed and has a higher elastic modulus than the typical polyisoprene thread, allowing the winding layer to require less of the ball's volume. Thus, the center can have an expanded portion of ball volume. This enables the golf ball designer to develop wound golf balls with larger centers and a thin wound elastic layer to produce unique playing characteristics.

The Thread Layer

Generally, the threads of the present invention preferably have a smaller cross-sectional area than the isoprene threads of the prior art, which results in greater packing density and superior properties. The threads of the present invention include a plurality of individual fibers or strands. The fibers are continuous filaments with small diameters. Because the thread includes many individual stands, the incidence of breakage of one strand has less effect than a breakage occurring with a single strand polyisoprene winding. If one strand of the invention thread breaks, the remaining strands will hold the winding secure. Thus, less dramatic results will occur if a single or a few strands break in the thread of the present invention in comparison to a breakage in prior art polyisoprene thread.

Figure 1:
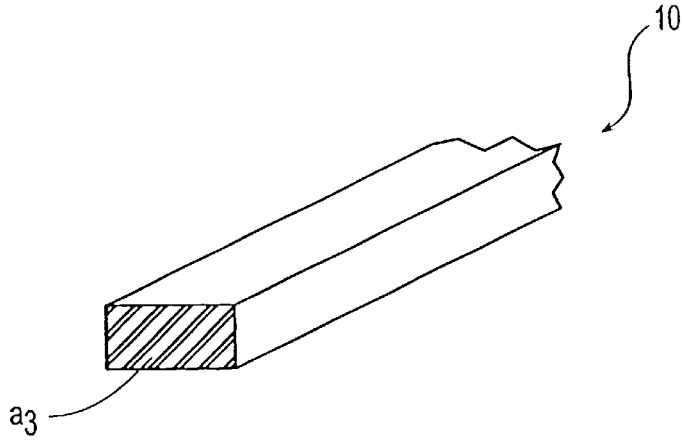
FIG. 1 PRIOR ART
FIG. 1 is an enlarged, partial perspective view of a conventional single-ply thread for use in a golf ball.
Figure 2:
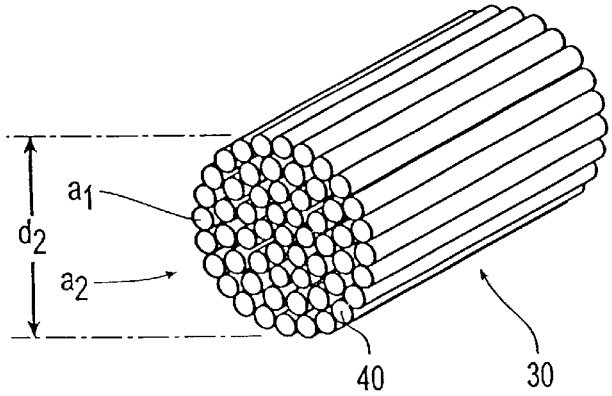
FIG. 2 is an enlarged, partial perspective view of a thread for use in a golf ball according to the present invention.

The wound thread 30 is preferably of a construction shown in FIG. 2. The thread 30 preferably includes over about 10 strands 40, and more preferably over about 50 strands 40. Most preferably, the thread contains greater than about 100 strands. As used herein, the term "about," used in connection with one or more numbers or numerical ranges, should be understood to refer to all such numbers, including all numbers in a range.

The invention utilizes a thread layer, such as polyether urea with properties similar to traditional natural rubber thread, yet is thinner than the natural rubber, and thus may be wound more tightly about the center. The result is a ball having more consistent properties than those found in the prior art. For instance, a conventional natural rubber thread has a thickness of about 0.014 to about 0.024 inches. The strands 40 of the present invention preferably have a diameter of less than about 0.01 inches, and more preferably less than about 0.002 inches. Because the individual strands 40 have a small area $a_1$, the cross-sectional area $a_2$ of the thread 30 is still smaller than the typical thread area $a_3$, generally about 0.0013 $in^2$, used to form a wound layer of a golf ball as shown by the prior art. In one embodiment, the strands 40 of the present invention have a cross-sectional area $a_1$ of less than about 0.0001 $in^2$ and most preferably less than about 0.00001 $in^2$. In another embodiment, the thread 30 of the present invention has a cross-sectional area $a_2$ of less than about 0.001 $in^2$ and most preferably less than about 0.0005 $in^2$.

The thread 30 preferably has an elongation to break of greater than about 8 percent prior to failure. More preferably, the thread has an elongation to break of greater than about 25 percent. A minimum of about 8 percent thread elongation prior to breakage allows the golf ball to deform during impact. A golf ball where the thread deforms significantly less than 8 percent during a typical driver impact will feel hard when struck and will have undesirable spin and feel characteristics. Preferably, the elastic modulus of the thread 30 in the wound state is greater than about 20,000 psi. More preferably, the elastic modulus is greater than 30,000 psi.

The strands of the thread may be held together with a binder as shown in FIG. 2 or they may be spun together. Melt spinning, wet spinning, dry spinning, and polymerization spinning may be used to produce threads.

Melt spinning is a highly economic process. Polymers are extruded through spinnerets by a heated spin pump. The resulting fibers are drawn off at rates up to 1200 m/min. The fibers are drawn and allowed to solidify and cool in the air. Because of the high temperatures required, only melting and thermally stable polymers can be melt spun. These polymers include poly(olefins), aliphatic polyamides, and aromatic polyesters.

For polymers that decompose on melting, the wet spinning method is used. Solutions of 5 percent to 20 percent are passed through the spinnerets by a spin pump. A precipitation bath is used to coagulate the filaments and a drawing or stretching bath is used to draw the filaments. Filament production rates under this method are lower than melt spinning, typically about 50 m/min to about 100 m/min. Because of solvent recovery costs, this method is less economical.

In dry spinning, air is the coagulating bath. The method is usable for polymers that decompose on melting, however only when readily volatile solvents are known for the polymers. Solutions of 20 percent to 55 percent are used. After leaving spinneret orifices, resulting filaments enter a 5 to 8-meter-long chamber. In the chamber, jets of warm air are directed toward the filaments. This causes the solvent to evaporate and the filaments to solidify. The process has higher rates of spinning than the wet spinning process. Typically, filament production rates are about 300 to about 500 m/min. The initial capital investment of equipment is higher, but the operation costs are lower than in wet spinning. Further, this process is only usable for spinning polymers for which readily volatile solvents are known.

In another method of spinning, polymerization spinning, a monomer is polymerized together with initiators, fillers, pigments, and flame retardants, or other selected additives. The polymerizate is directly spun at rates of about 400 m/min. The polymerizate is not isolated. Only rapidly polymerizing monomers are suitable for this method. For example, LYCRA® is produced by polymerization spinning.

The thread preferably includes a polymeric material. Suitable polymers include polyether urea, such as LYCRA®, polyester urea, polyester block copolymers such as HYTREL®, isotactic-poly(propylene), polyethylene, polyamide, poly(oxymethylene), polyketon, poly(ethylene terephthalate) such as DACRON®, poly(p-phenylene terephthalamide) such as KEVLAR®, poly(acrylonitrile) such as ORLON®, trans, trans-diaminodicyclohexylmethane and dodecanedicarboxylic acid such as QUINA®. LYCRA®, HYTREL®, DACRON®, KEVLAR®, ORLON®, and QUINA® are available from E.I. DuPont de Nemours & Co. of Wilmington, Del. Glass fiber and, for example, S-GLASS® from Corning Corporation can be used.

Alternatively, threads made from natural fibers are contemplated for use in the present invention. More particularly, mineral fibers such as silicates, vegetable fibers such as cellulosic and animal fibers are contemplated. More particularly, the vegetable fibers can be broken into four groups: bast fibers, leaf fibers, seed-hair fibers and palm fibers. Bast fibers include those made from the bark or stems of certain plants, leaf fibers include those made from cordage, seed-hair fibers comprise cotton and kapok and palm fibers originate from other parts of plants.

The thread 30 may also include strands 40 having different chemical, mechanical, and/or physical properties to achieve desired stretch and elongation characteristics. For example, the thread 30 may include strands 40 of a first elastic type of material that is weak, but resilient, and also strands 40 of a second elastic type of material that is stronger but less resilient. In another example, the thread may be include at least one strand of polyisoprene rubber thread having a diameter of less than about 0.006 inches. This strand may be surrounded by about 10 to about 50 polyether urea strands having diameters of less than about 0.002 inches.

The manufacturing process for wound cores is such that the elastic fiber is extended during the winding process and then remains in the elongated state permanently. During use, when the club strikes the golf ball, a small perturbation or additional extension is applied to the wound thread as a result of ball deformation. Therefore, to properly characterize elastic fiber performance, one should make measurements that emulate use conditions. This is especially true for elastic fibers, as the stress strain relationship for these materials is highly nonlinear.

Figure 2A:
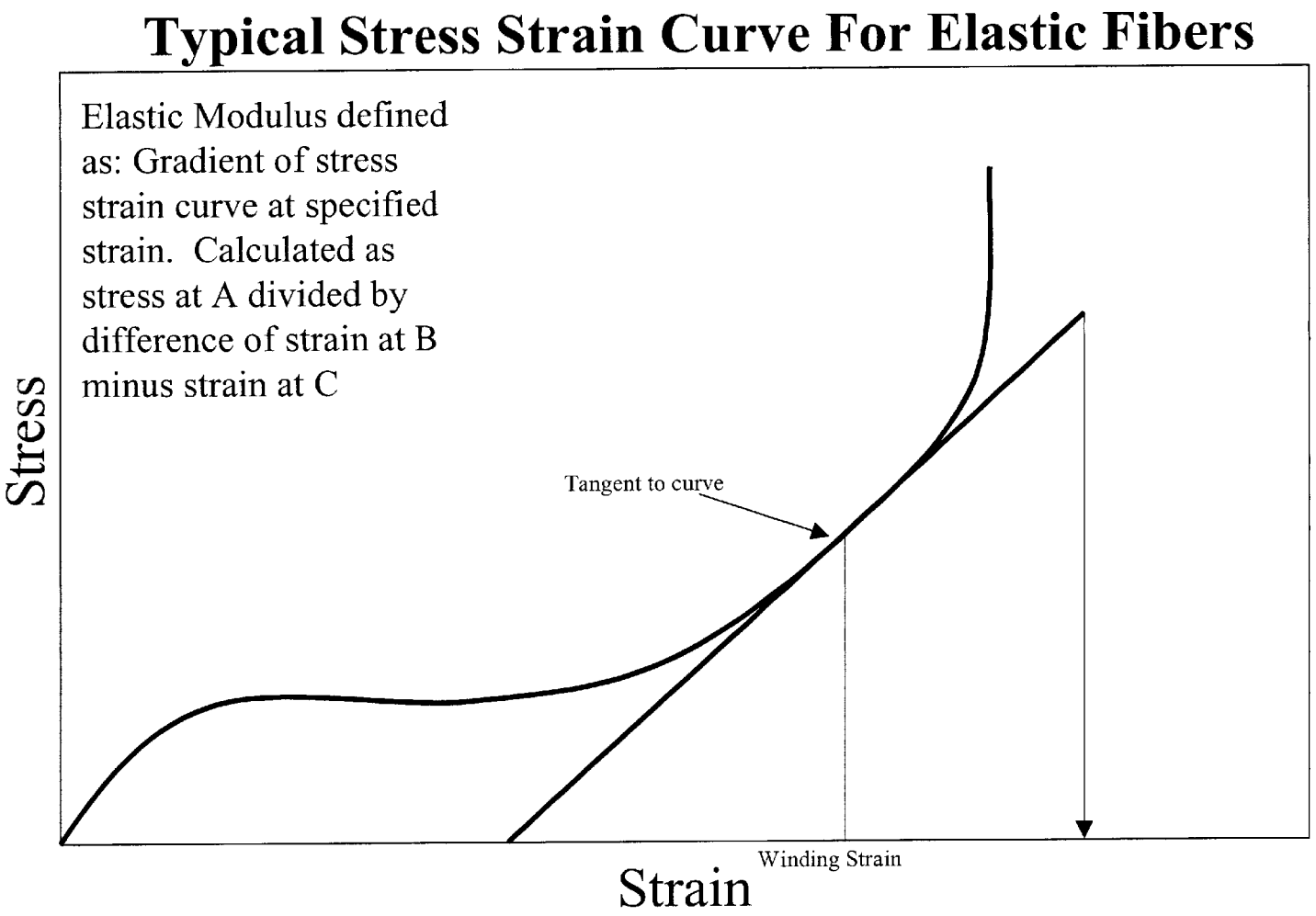
FIG. 2A is a graph illustrating a typical stress strain curve for elastic fibers.

The elastic modulus is measured by clamping the elastic fibers in a test apparatus and elongating the fibers to an extension comparable to the extension associated with the core winding process. For example, in the case of polyisoprene thread, extensions between 500 percent and 1000 percent are typical. When spun LYCRA® thread is used, winding elongations between 100 percent to 400 percent are typical. The gradient of the stress strain curve at the "winding" elongation is the elastic modulus. Referring to FIG. 2A, the elastic modulus at winding strain may be computed from the line drawn tangent to the stress strain curve at the winding strain. The elastic modulus is computed as the stress value of A minus B divided by the strain value of B minus C.

In one embodiment, the thread 30 is formed from solvent spun polyether urea elastomer LYCRA® made by E.I. DuPont de Nemours & Company of Wilmington, Del. This thread 30 may be manufactured with a cross-sectional area much smaller than the isoprene threads typically used in forming the wound layer 70 of a golf ball. Because of the thread's 30 smaller diameter $d_2$, it may be used to form golf balls 50 and cores with greater packing density and superior properties. Also, the elastic modulus of the solvent spun polyether urea thread is greater than about 30,000 psi when elongated. Specifically, the elastic modulus may be between about 30,000 psi to about 50,000 psi when elongated between about 200 percent and 400 percent. Elongation yielding optimal resilience of the thread may be between about 200 percent and 500 percent.

Because the threads 30 have a smaller cross-sectional area and a higher modulus of elasticity, the total volume $V_2$ of the thread 30 needed to form the wound layer 70 of a golf ball 50 is less. Because less volume is needed for the wound layer 70, the volume $V_1$ of the center 60 may be increased. Use of a larger solid center 60 or liquid center 60 can improve alterable characteristics. Such alterable characteristics include spin and compression.

Figure 4:
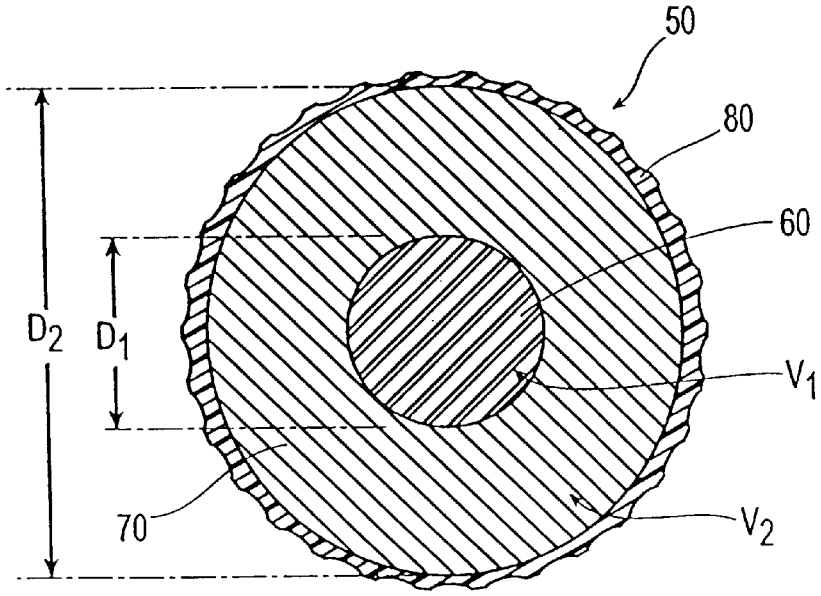
FIG. 4 is a cross-sectional view of the golf ball of FIG. 3 according to the present invention.
Figure 5:
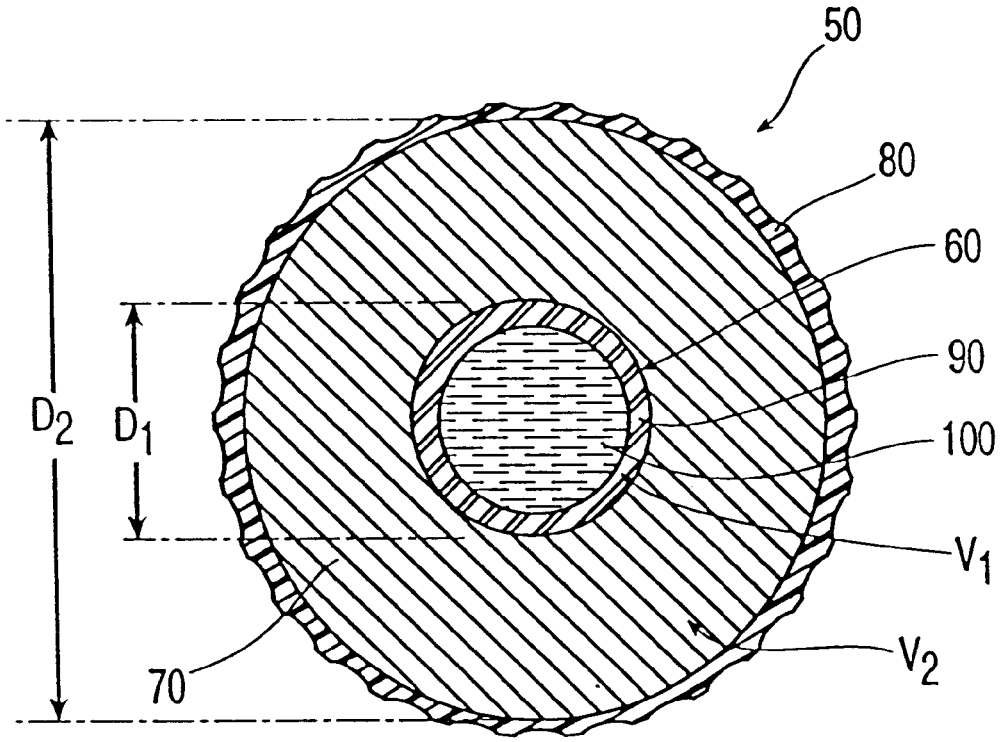
FIG. 5 is a cross-sectional view of the golf ball of FIG. 3 according to another embodiment of the present invention.

As shown in FIGS. 4 and 5, the thread 30 is wound about the center 60 to form the wound layer 70. The thickness of the wound layer is preferably about 0.2 inches or less. The windings of the present invention may be wound according to conventional processes and technology. The winding can use the same or various levels of tension and elongation in a conventional fashion. For example, initially the winding can occur at low tension and then at a predetermined time or diameter, the winding can occur at high tension.

The Center

The center 60 of the present invention may be of any dimension or composition. In one embodiment, shown in FIG. 4, the center 60 is solid. The center could be a thermoset rubber, a thermoplastic material, wood, cork, metal, or any material known to one skilled in the art of ball manufacture. Preferably, the center includes a resilient polymer such as polybutadiene, natural rubber, polyisoprene, styrene-butadiene, or ethylene-propylene-diene rubber. Similarly, as shown in FIG. 5, the center 60 could be a liquid-filled sphere or shell 90 such as a rubber sack, a thermoplastic, or metallic shell design. The liquid 100 employed could be of any composition or viscosity. It is also feasible to construct such a center 60 with a void or gas center. In another embodiment, the center can be filled with a liquid, a gel, a paste, or a cellular foam. The center may be a single layer or multi-layer.

The center 60 is larger than a typical center because the smaller volume $V_2$ of wound thread 30 around the center 60 enables the center 60 to have a larger volume $V_1$ for a predetermined golf ball diameter. Preferably, the center has an outer diameter $D_1$ of at least about 1 inch, more preferably from about 1.1 inches to about 1.55 inches. Most preferably, the outer diameter $D_1$ of the center is about 1.2 to about 1.55 inches. Preferably, the wound layer 70 has an outer diameter $D_2$ of about 1.4 to about 1.62 inches. The use of a center 60 with a larger diameter $D_1$ results in improved golf ball characteristics.

A representative base composition for forming a golf ball center 60, which includes at least one layer as shown in FIG. 4, includes polybutadiene and, in parts by weight based on 100 parts polybutadiene, 0 to 50 parts of a metal salt diacrylate, dimethacrylate, or monomethacrylate, preferably zinc diacrylate. Commercial sources of polybutadiene include Cariflex 1220® manufactured by Shell Chemicals, Neocis BR40® manufactured by Enichem Elastomers, and Ubepol BR150® manufactured by Ube Industries, Ltd of Japan. If desired, the polybutadiene can also be mixed with other elastomers known in the art, such as natural rubber, styrene butadiene, and/or polyisoprene in order to further modify the properties of the center 60. When a mixture of elastomers is used, the amounts of other constituents in the core composition are based on 100 parts by weight of the total elastomer mixture.

Metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it provides golf balls with a high initial velocity. The zinc diacrylate can be of various grades of purity. For the purposes of this invention, the lower the quantity of zinc stearate present in the zinc diacrylate the higher the zinc diacrylate purity. Zinc diacrylate containing less than about 10 percent zinc stearate is preferable. More preferable is zinc diacrylate containing about 4 percent to 8 percent zinc stearate. Suitable, commercially available zinc diacrylates includes those from the Sartomer Corporation of Exton, Pa. The preferred concentrations of zinc diacrylate that can be used are from 0 to about 50 parts per hundred (pph) and preferably about 10 to about 30 pph based upon 100 pph of polybutadiene or alternately, polybutadiene with a mixture of other elastomers that equal 100 pph.

Free radical initiators are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di-(t-butylperoxy)-3,3,5-trimethyl cyclohexane, a-a bis(t-butylperoxy) diisopropylbenzene, 2,5-dimethyl-2,5-di-(t-butylperoxy) hexane, or di-t-butyl peroxide, and mixtures thereof. Other useful initiators would be readily apparent to one of ordinary skill in the art without any need for experimentation. The initiator(s) at 100 percent activity are preferably added in an amount ranging between about 0.05 pph and about 2.5 pph based upon 100 parts of butadiene, or butadiene mixed with one or more other elastomers. More preferably, the amount of initiator added ranges between about 0.15 pph and about 2 pph and most preferably between about 0.25 pph and about 1.5 pph.

A typical golf ball center incorporates about 1 pph to about 50 pph of zinc oxide in a zinc diacrylate-peroxide cure system that cross-links polybutadiene during the core molding process.

The center compositions of the present invention may also include fillers, added to the elastomeric composition to adjust the density and/or specific gravity of the core. As used herein, the term "fillers" includes any compound or composition that can be used to vary the density and other properties of the subject golf ball core. Fillers useful in the golf ball core according to the present invention include, for example, zinc oxide, barium sulfate, and regrind (which is recycled core material ground to about 30 mesh particle size). The amount and type of filler utilized is governed by the amount and weight of other ingredients in the composition, since a maximum golf ball weight of 1.620 ounces (45.92 g) has been established by the USGA. Appropriate fillers generally used range in specific gravity from about 2.0 to about 5.6.

Antioxidants may also be included in the elastomer centers produced according to the present invention. Antioxidants are compounds which prevent the breakdown of the elastomer. Antioxidants useful in the present invention include, but are not limited to, quinoline type antioxidants, amine type antioxidants, and phenolic type antioxidants.

Other ingredients such as accelerators, e.g., tetra methylthiuram, peptizers, processing aids, processing oils, plasticizers, dyes and pigments, as well as other additives well known to the skilled artisan may also be used in the present invention in amounts sufficient to achieve the purpose for which they are typically used.

A cis-trans conversion catalyst may also be included in the present invention. The catalyst may be an organosulfur or metal-containing organosulfur compound, a substituted or unsubtituted aromatic organic compound that does not contain sulfur or metal, an inorganic sulfide compound, an aromatic organometallic compound, or mixtures thereof. A "cis-to-trans catalyst" herein, means any compound or a combination thereof that will convert at least a portion of cis-polybutadiene isomer to trans-polybutadiene isomer at a given temperature.

As shown in FIG. 5, a center 60 can also be a liquid-filled shell 90. The shell 90 can be filled with a wide variety of materials 100 including air, water solutions, gels, foams, hot-melts, other fluid materials and combinations thereof, as set forth in U.S. Pat. No. 5,683,312, which is incorporated herein by reference.

Examples of suitable liquids include either solutions such as salt in water, corn syrup, salt in water and corn syrup, glycol and water or oils. The liquid can further include pastes, colloidal suspensions, such as clay, barytes, carbon black in water or other liquid, or salt in water/glycol mixtures. Examples of suitable gels include water gelatin gels, hydrogels, water/methyl cellulose gels and gels including copolymer rubber based materials such a styrene-butadiene-styrene rubber and paraffinic and/or naphthenic oil. Examples of suitable melts include waxes and hot melts. Hot-melts are materials which at or about normal room temperatures are solid but at elevated temperatures become liquid. A high melting temperature is desirable since the liquid core is heated to high temperatures during the molding of the cover.

The liquid 100 within the shell 90 can be a reactive liquid system which combine to form a solid. Examples of suitable reactive liquids are silicate gels, agar gels, peroxide cured polyester resins, two part epoxy resin systems and peroxide cured liquid polybutadiene rubber compositions. It is understood by one skilled in the art that other reactive liquid systems can likewise be utilized depending on the physical properties of the shell and the physical properties desired in the resulting finished golf balls.

The Cover

Figure 3:
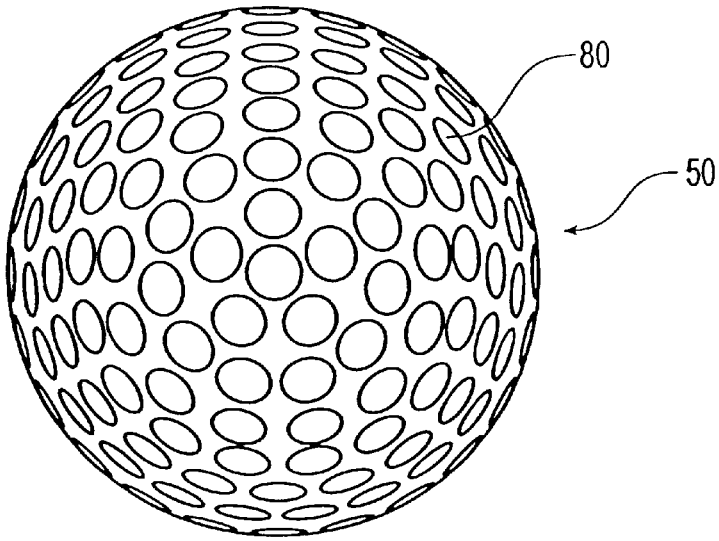
FIG. 3 is an elevational view of a golf ball according to the present invention.

Referring to FIG. 3, the cover 80 provides the interface between the ball 50 and a club. Properties that are desirable for the cover 80 are good moldability, high abrasion resistance, high tear strength, high resilience, and good mold release, among others. In accordance with the preferred balls, the cover 80 has a thickness to generally provide sufficient strength, good performance characteristics and durability. Preferably, the cover 80 is of a thickness from about 0.03 inches to about 0.12 inches. More preferably, the cover 80 is about 0.04 to about 0.09 inches in thickness and, most preferably, is about 0.05 to about 0.085 inches in thickness.

Any process that results in accurate and repeatable central placement of the core within the cover is acceptable. Generally, covers are applied by compression molding, injection molding (e.g., liquid injection molding, reinforced reaction injection molding, and structural reaction injection molding), or by casting cover material over the core. One suitable method for applying a cover to a ball is disclosed in the "pinless" centering method of U.S. Pat. No. 5,947,843, which is incorporated in its entirety by reference herein.

The cover 80 of the golf ball 50 can include one or more layers and is generally made of polymeric materials such as ionic copolymers of ethylene and an unsaturated monocarboxylic acid which are available under the trademark SURLYN® of E.I. DuPont de Nemours & Company of Wilmington, Del. or IOTEK® or ESCOR® from Exxon Corp. of Irving, Tex. These are copolymers or terpolymers of ethylene and methacrylic acid or acrylic acid partially neutralized with zinc, sodium, lithium, magnesium, potassium, calcium, manganese, nickel or the like.

In another embodiment, the cover 80 can be formed from mixtures or blends of zinc, lithium and/or sodium ionic copolymers or terpolymers.

Also, SURLYN® resins for use in the cover 80 are ionic copolymers or terpolymers in which sodium, lithium or zinc salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The invention can likewise be used in conjunction with covers 80 having homopolymeric and copolymer materials such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using single-site catalyst.

(3) Polyurethanes such as those prepared from polyols and diisocyanates or polyisocyanates and those disclosed in U.S. Pat. No. 5,334,673, which is incorporated in its entirety by reference herein.

(4) Polyureas such as those disclosed in U.S. Pat. No. 5,484,870, which is incorporated in its entirety by reference herein.

(5) Polyamides such as poly(hexamethylene adipamide) and others prepared from diamines and dibasic acids, as well as those from amino acids such as poly (caprolactam), and blends of polyamides with Surlyn, polyethylene, ethylene copolymers, ethyl-propylene-non-conjugated diene terpolymer, etc.

(6) Acrylic resins and blends of these resins with poly vinyl chloride, elastomers, etc.

(7) Thermoplastics such as the urethanes, olefinic thermoplastic rubbers such as blends of polyolefins with ethylene-propylene-non-conjugated diene terpolymer, block copolymers of styrene and butadiene, isoprene or ethylene-butylene rubber, or copoly(ether-amide), such as PEBAX® sold by ELF Atochem of France.

(8) Polyphenylene oxide resins, or blends of polyphenylene oxide with high impact polystyrene as sold under the trademark NORYL® by General Electric Company, Pittsfield, Mass.

(9) Thermoplastic polyesters, such as polyethylene terephthalate, polybutylene terephthalate, polyethylene terephthalate/glycol modified and elastomers sold under the trademarks HYTREL® by E.I. DuPont de Nemours & Company of Wilmington, Del. and LOMOD® by General Electric Company, Pittsfield, Mass.

(10) Blends and alloys, including polycarbonate with acrylonitrile butadiene styrene, polybutylene terephthalate, polyethylene terephthalate, styrene maleic anhydride, polyethylene, elastomers, etc. and polyvinyl chloride with acrylonitrile butadiene styrene or ethylene vinyl acetate or other elastomers. Blends of thermoplastic rubbers with polyethylene, propylene, polyacetal, nylon, polyesters, cellulose esters, etc.

Preferably, the cover 80 includes polymers such as ethylene, propylene, utene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly (tetrafluoroethylene) and their copolymers including functional comonomers and blends thereof.

In one embodiment, the cover 80 includes materials such as polyether or polyester thermoplastic urethanes, thermoset urethanes, and ionomers such as acid-containing ethylene copolymer ionomers, including E/X/Y terpolymers where E is ethylene, X is an acrylate or methacrylate-based softening comonomer present in 0 to 50 weight percent and Y is acrylic or methacrylic acid present in 5 to 35 weight percent. More preferably, in a low spin rate embodiment designed for maximum distance, the acrylic or methacrylic acid is present in 15 to 35 weight percent, making the ionomer a high modulus ionomer. In a high spin embodiment, the cover includes an ionomer where an acid is present in 10 to 15 weight percent and includes a softening comonomer.

Castable reactive liquid materials are particularly preferred for the outer cover layers of the balls of the present invention. As used herein, the term "castable reactive liquid material" may refer to thermoset or thermoplastic materials. In a preferred embodiment, the castable reactive liquid material is a thermoset material. As used herein, the term "thermoset" refers to an irreversible, solid polymer that is the product of the reaction of two or more prepolymer precursor materials formed from a castable reactive liquid material.

In another preferred embodiment, the castable reactive liquid material is cast urethane or polyurethane. Polyurethane is a product of a reaction between a polyurethane prepolymer and a curing agent. The polyurethane prepolymer is a product formed by a reaction between a polyol and a diisocyanate. Often a catalyst is employed to promote the reaction between the curing agent and the polyurethane prepolymer. In the case of cast polyurethanes, the curing agent is typically either a diamine or glycol.

In another preferred embodiment, the castable reactive liquid material is a thermoset cast polyurethane. Thermoset cast polyurethanes are generally prepared using a diisocyanate, such as 2,4-toluene diisocyanate (TDI) or methylenebis-(4-cyclohexyl isocyanate) (HMDI) and a polyol which is cured with a polyamine, such as methylenedianiline (MDA), or a trifunctional glycol, such as trimethylol propane, or tetrafunctional glycol, such as N,N,N',N'-tetrakis(2-hydroxpropyl)ethylenediamine.

However, the present invention is not limited to just these specific types of thermoset cast polyurethanes. Quite to the contrary, any suitable cast or non-cast thermoset polyurethane may be employed to form outer cover layers of the present invention.

Other suitable thermoset materials contemplated for the cover layers include, but are not limited to, thermoset urethane ionomers and thermoset urethane epoxies. Examples of suitable thermoset polyurethane ionomers are disclosed in U.S. Pat. No. 5,692,974, which is incorporated in its entirety by reference herein. Other examples of thermoset materials include polybutadiene, natural rubber, polyisoprene, styrene-butadiene, or styrene-propylene-diene rubber, which are particularly suitable when used in an intermediate layer of a golf ball.

When the cover 80 includes more than one layer, e.g., an inner cover layer and an outer cover layer, various constructions and materials are suitable. For example, an inner cover layer may surround the windings with an outer cover layer disposed thereon. In another embodiment, an inner cover layer may surround an intermediate layer.

When using an inner and outer cover layer construction, the outer cover layer material is preferably a thermoset material that includes at least one of a castable reactive liquid material and reaction products thereof, as described above, and preferably has a hardness from about 30 Shore D to about 60 Shore D. In one embodiment, the outer cover layer is thin, preferably less than about 0.05 inches, and more preferably from about 0.02 inches to about 0.045 inches.

The inner cover layer may be formed from a wide variety of hard (about 65 Shore D or greater, preferably from about 69 Shore D to about 74 Shore D), high flexural modulus resilient materials, which are compatible with the other materials used in the adjacent layers of the golf ball. The inner cover layer materials preferably has a flexural modulus of about 65,000 psi or greater. In one embodiment, the flexural modulus of the inner cover layer material is from about 70,000 psi to about 120,000 psi.

Suitable inner cover layer materials include the hard, high flexural modulus ionomer resins and blends thereof as disclosed in U.S. Pat. No. 5,885,172, which is incorporated in its entirety by reference herein. These ionomers are obtained by providing a cross metallic bond to polymers of monoolefin with at least one member selected from the group consisting of unsaturated mono- or di-carboxylic acids having 3 to 12 carbon atoms and esters thereof (the polymer contains 1 to 50% by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0–50 (preferably 0–25, most preferably 0–20), weight percent of the polymer, and Y is acrylic or methacrylic acid present in 5–35 (preferably at least about 16, more preferably at least about 16–35, most preferably at least about 16–20) weight percent of the polymer, wherein the acid moiety is neutralized 1–90% (preferably at least 40%, most preferably at least about 60%) to form an ionomer by a cation such as lithium*, sodium*, potassium, magnesium*, calcium, barium, lead, tin, zinc* or aluminum (*=preferred), or a combination of such cations. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

The manner in which the ionomers are made is well known in the art, as described in, e.g., U.S. Pat. No. 3,262,272, which is incorporated in its entirety by reference herein. Such ionomer resins are commercially available from DuPont under the tradename SURLYN® and from Exxon under the tradename Iotek®. Some particularly suitable SURLYNS® include SURLYN® 8140 (Na) and SURLYN® 8546 (Li) which have an methacrylic acid content of about 19 percent.

Examples of other suitable inner cover materials include thermoplastic or thermoset polyurethanes, polyetheresters, polyetheramides, or polyesters, dynamically vulcanized elastomers, functionalized styrene-butadiene elastomers, metallocene polymers, polyamides such as nylons, acrylonitrile butadiene-styrene copolymers (ABS), or blends thereof. Suitable thermoplastic polyetheresters include materials which are commercially available from DuPont under the tradename Hytrel®. Suitable thermoplastic polyetheramides include materials which are available from Elf-Atochem under the tradename Pebax®.

Ball Construction

Referring to FIGS. 2–5, the golf ball of the invention 50 includes at least a center 60, a wound layer 70 of thread 30, and a cover 80.

The golf balls 50 may be made by any conventional process employed in the golf ball art. For example, the golf ball 50 of FIG. 4 is manufactured by injection or compression molding the solid center 60. The thread 30 is then wound about the solid center 60 to form the wound layer 70. Different elongations are used depending on the desired results for ball performance. The cover layer or layers 80 is then injection molded, reaction injection molded (e.g., liquid injection molding, reinforced reaction injection molding, and structural reaction injection molding), compression molded, or cast about the wound layer 70 which processes are well known in the art.

Turning to FIG. 5, a golf ball 50 of the present invention can also be formed by initially forming the shell 90 by compression molding hemispherical cups, the cups are bonded together to form the shell 90 to create a cavity and filling the cavity with fluid or liquid 100 to form the center 60. The thread 30 is then wound around the shell 90 to form the wound layer 70. Different elongations are used depending on the desired results for ball performance. The cover 80 may then be compression molded, injection molded, reaction injection molded, or cast over the wound layer 70.

Figure 6:
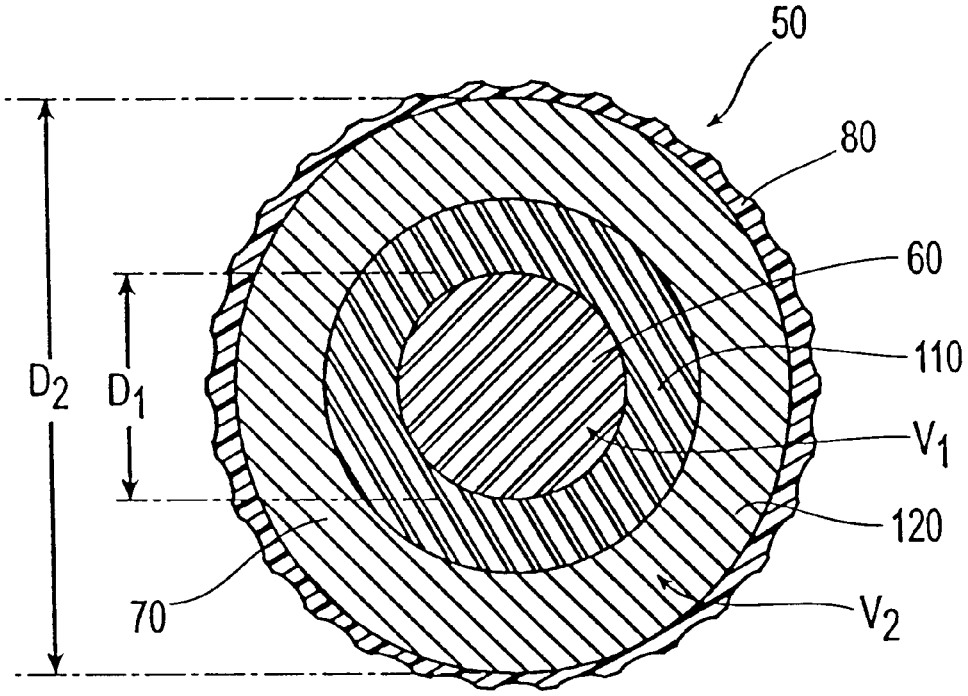
FIG. 6 is a cross-sectional view of another embodiment of a golfball according to the present invention.

As shown in FIG. 6, the golf ball 50, in yet another embodiment, includes a center 60, a cover 80 and a wound component 70, including a first wound 110 and a second wound layer 120, therebetween. The first wound layer has first threads according to the present invention and the second layer 120 has threads having different chemical, mechanical and/or physical properties than the first threads. The first threads include about 10 or more individual fibers or strands. Preferably, the thread contains more than about 50 strands. The strands are continuous filaments with diameters typically of less than about 0.01 inches. Preferably, the strand diameter is less than about 0.002 inches In one embodiment, the second threads are either single-ply or two-ply threads as is well known in the art. Most preferably, the second thread is a two-ply thread made by mixing synthetic cis-polyisoprene rubbers, natural rubber and a curing system together, calendering this mixture into two sheets, curing the sheets, and slitting the sheets into threads having a generally rectangular or square cross-section. In another embodiment, the second threads 120 are also include threads according to the present invention, but have different physical, mechanical, and/or chemical properties than the first strands. Preferably, the second threads have an elastic modulus at winding that is at least about 10 percent different from the elastic modulus of the first thread.

The invention also relates to a multi-layer golf ball with a wound thread layer between rubber-based layers. Referring to FIGS. 4–6, the golf ball of the invention 50 includes at least a center 60, a wound layer 70 of thread 30, one or more intermediate layers surrounding the wound layer 70 (not shown), and a cover 80. The materials used in the various layers may be altered to produce golf balls with a variety of performance and feel characteristics. The intermediate layer, combined with the improved thread layer, provides added resilience as compared to prior art golf balls.

In this construction, the center may be a single or multi-layer center which may include a dual core or be liquid filled. Preferably, the center includes a solid core including a resilient polymer, such as polybutadiene, natural rubber, polyisoprene, styrene-butadiene, styrene-propylene-diene rubber, or a mixture thereof. Preferably, the outer diameter of the center is at least about 0.5 inches, more preferably about 0.5 to about 1.4 inches. In another embodiment, the center has a diameter of at least about 1 inch, preferably about 1.2 to about 1.55 inches.

The one or more wound layers may be applied using any conventional method for applying a threaded layer to a golf ball. The wound layer may be of variable thickness and may include one or more threads. The wound layer is intended to provide a cushion between the center and the intermediate layers. Preferably, the wound thread layer includes one or more of the following: polyether urea, such as LYCRA®, polyester urea, polyester block copolymers, such as HYTREL®, polyethylene, polyamide, polyketon, poly (p-phenylene terepahthalamide), such as KEVLAR®, or polyisoprene. Preferably, the thickness of the wound layer is about 0.2 inches or less.

The one or more intermediate layers may be a solid layer including at least one resilient polymer, preferably a thermoset material, such as polybutadiene, natural rubber, polyisoprene, styrene-butadiene, or styrene-propylene-diene rubber. Preferably, the intermediate layer contains trans-polyisoprene, trans-polybutadiene, or a mixture thereof. This layer may have the same or different properties from the center. The layer may be produced by injection or compression molding the rubber stock over the wound core. Preferably, the thickness of the intermediate layer is about 0.15 inches or less. In another embodiment, the thickness of the intermediate layer is about 0.1 inches or less.

The one or more cover layers may include a variety of materials as discussed above. For example, castable reactive liquid materials, such as cast polyurethanes, and thermoplastic resins, such as SURLYN®, may be used. When more than one cover layer is used, an inner cover layer may surround the intermediate layer with the outer cover layer disposed thereon as discussed above. Preferably, balls requiring a lower spin and longer distance will include an ionomer resin in the outer cover layer, and balls requiring a higher spin rate for more control will include polyurethane in the outer cover layer. The inner cover layer may be formed from the wide variety of hard, high flexural modulus resilient materials as discussed above. The cover layers may be formed by any conventional method known to those of ordinary skill in the art.

In one embodiment, a thin layer of polyether urea is wound over a dual core center to create a cushion layer between the center and the intermediate layer. The wound layer may help reduce the stress propagation between the relatively soft surface of the center and the relatively hard surface of the intermediate layer. In another embodiment, a thick layer of polyisoprene thread is wound over a dual core center to achieve a highly resilient, multi-layer ball.

EXAMPLES

These and other aspects of the present invention may be more fully understood with reference to the following non-limiting examples, which are merely illustrative of the preferred embodiment of the present invention golf ball construction, and are not to be construed as limiting the invention, the scope of which is defined by the appended claims.

Example 1

A golf ball according to the present invention had a solid center, a wound layer surrounding the solid center, and a cover surrounding the wound layer.

The center included a solid polybutadiene composition and had a diameter of about 1.39 inches. The center was wound with a thread, LYCRA®, including polymerization spun polyether urea. The thread included about 125 strands with diameters of about 0.0001 inches. The area of the thread was about 0.00017 $in^2$. The center diameter was 1.39 inches, and the center and the windings had an outer diameter of about 1.56 inches. The thread was wound about the center at elongations to about 300 percent. The windings were then covered by a compression molded SURLYN® cover.

The following chart compares the center composition of the ball made according to Example 1 of the present invention with the center composition of a comparative ball.

Center Composition

| Constituent | Example 1 Parts | Comparative Parts |
|---|---|---|
| Polybutadiene | 100 | 90.22 |
| Polyisoprene | | 9.78 |
| Zinc Diacrylate | 24 | |
| Zinc Oxide | | 5.00 |
| Dicumyl Peroxide | | 1.60 |
| Di(2-t-butyl-peroxyisopropyl)benzene | 0.096 | |
| Calcium Oxide | 2.16 | |
| Barium Sulfate | 43.68 | 132.87 |
| 1,1-bis(t-butylperoxy)-3,3,5-trimethylcyclohexane | 0.172 | 9.78 |
| 2,2'-methylene-bis-4 methyl-6-tert-butylphenol | | 0.74 |

-continued

Center Composition

| Constituent | Example 1 Parts | Comparative Parts |
|---|---|---|
| STRUKTOL WB 212* ® | | 11.10 |
| Calcium Carbonate | | 46.76 |
| Trimethylolpropane Trimethacrylate | | 9.78 |

*STRUKTOL WB212 ® is a processing aid available from Struktol Corp.

The following chart compares the cover layer composition of the ball made according to Example 1 with the cover composition of the comparative ball.

Cover Composition

| Constituent | Example 1 Parts | Comparative Parts |
|---|---|---|
| SURLYN ® 8140 | 20 | 20 |
| SURLYN ® 7940 | 30 | 30 |
| SURLYN ® 7930 | 50 | 50 |

Example 2

A golf ball according to the present invention had a liquid center enclosed by a shell, a wound layer surrounding the liquid center, and a cover surrounding the wound layer.

The liquid center was a salt, water and corn syrup solution including 40 percent salt, 30 percent water and 30 percent corn syrup. The liquid was surrounded by a polypropylene shell. The liquid center had a outer diameter of about 1.3 inches. The center was wound with a thread, LYCRA®, including solvent spun polyether urea. The thread included about 125 strands with diameters of about 0.0001 inch. The outer diameter of the center and the windings was about 1.58 inches. The thread was wound at elongations to about 300 percent. The windings were then covered by a molded ionomer cover.

Example 3

A golf ball according to the present invention had a solid center, a wound layer surrounding the solid center, and a cover surrounding the wound layer.

The solid center included a polybutadiene composition. The center had a outer diameter of about 1.4 inches. The center was wound with a thread including melt spun polyethylene SPECTRA. The thread included about 100 strands with diameters of about 0.0001 inch. The outer diameter of the center and the windings was about 1.58 inches. The thread was wound at elongations to about 2 percent. The windings were then covered by a molded polyurethane cover.

Example 4

The table below shows golf ball center compositions prepared according to the present invention with 26 pph zinc diacrylate (ZDA), 4.3 pph zinc oxide, 0.53 pph Trigonox-265. Trigonox-265 is a mixture of 1,1-di(t-butylperoxy)-3,3,5-trimethycyclohexane and di(2-t-butylperoxyisopropyl) benzene and is commercially available from Akzo Nobel Chemicals, Inc. of Chicago, Ill.

| | Center 1 | Center 2 | Center 3 | Center 4 | Center 5 | Center 6 |
|---|---|---|---|---|---|---|
| Tungsten (pph) | 36.2 | 38.3 | 41.9 | 44 | 49 | 51.2 |
| Specific Gravity | 1.29 | 1.305 | 1.33 | 1.345 | 1.38 | 1.395 |
| Center diameter (in.) | 1.125 | 1.125 | 1.127 | 1.127 | 1.127 | 1.125 |
| Winding layer thickness (in.) | 0.175 | 0.175 | 0.273 | 0.273 | 0.373 | 0.375 |
| Intermediate layer thickness (in.) | 0.281 | 0.28 | 0.181 | 0.181 | 0.082 | 0.081 |
| Center Weight (g) | 16.38 | 16.56 | 16.9 | 17.03 | 17.75 | 17.55 |
| Center Compression | 55 | 53 | 52 | 58 | 58 | 55 |
| Center COR | 0.784 | 0.783 | 0.778 | 0.779 | 0.778 | 0.778 |
| Core Weight (g) | 40.1 | 40.34 | 40.4 | 40.78 | 41.53 | 41.33 |
| Core Compression | 67 | 68 | 51 | 54 | 48 | 47 |
| Core COR | 0.785 | 0.786 | 0.777 | 0.778 | 0.779 | 0.776 |
| Finished Ball Diameter (in.) | 1.685 | 1.685 | 1.689 | 1.688 | 1.689 | 1.689 |
| Finished Ball Weight (oz.) | 1.634 | 1.645 | 1.65 | 1.659 | 1.683 | 1.676 |
| Finished Ball Compression | 79.1 | 78 | 65.9 | 66.6 | 60.7 | 59.9 |
| Finished Ball COR | 0.792 | 0.796 | 0.789 | 0.79 | 0.789 | 0.789 |

The table below shows the results of spin tests versus the control for balls made with centers 2, 4, and 6, respectively.

| | Center 2 | Center 4 | Center 6 |
|---|---|---|---|
| Driver (rpm) | +100 | +200 | +400 |
| Eight iron (rpm) | +400 | +600 | +900 |
| Half wedge (rpm) | +100 | +150 | +200 |

Example 5

A golf ball according to the present invention has a solid center, a wound layer surrounding the solid center, and a multi-layer cover molded thereon.

In this example, the center includes a solid polybutadiene composition and has a diameter of about 1.55 inches. The center is wound with a thread, LYCRA®, made of polymerization spun polyether urea. The thread includes about 125 strands with diameters of about 0.0001 inches. The area of the thread is about 0.00017 $in^2$. The center and the windings have an outer diameter of about 1.58 inches. The thread is wound about the center at elongations to about 300 percent. The dual cover layer is formed around the windings using the materials and processes disclosed in U.S. Pat. No. 5,885,172.

Example 6

A golf ball according to the present invention may have a solid center, a wound layer surrounding the solid center, an intermediate layer surrounding the wound layer, and a cover molded thereon.

In this example, the center includes a solid polybutadiene composition. The center is wound with a thread, LYCRA®, made of polymerization spun polyether urea. The thread includes about 125 strands with diameters of about 0.0001 inches. The area of the thread is about 0.00017 $in^2$. The center and the windings have an outer diameter of about 1.56 inches. The thread is wound about the center at elongations to about 300 percent. The windings are then covered using a conventional compression molding technique with an intermediate layer including a mixture of trans-polyisoprene and polybutadiene molded thereon by compression molding, injection molding, reaction injection molding, or casting. The polyurethane cover layer is formed following the pinless centering process set forth in U.S. Pat. No. 5,947,843.

Example 7

A golf ball according to the present invention may have a solid center, a wound layer surrounding the solid center, and a multi-layer cover molded thereon.

In this example, the center includes a solid polybutadiene composition. The center was wound with a thread, LYCRA®, including polymerization spun polyether urea. The thread includes about 125 strands with diameters of about 0.0001 inches. The area of the thread is about 0.00017 $in^2$. The center and the windings have an outer diameter of about 1.6 inches. The thread is wound about the center at elongations to about 200 percent. The cover layers are formed following the processes as disclosed in U.S. Pat. No. 5,885,172. The inner cover layer is formed of an ionomer resin having a methacrylic acid content of about 19 wt percent. The outer cover layer is formed of a 40D castable urethane having a hardness of about 60 Shore D or less.

Example 8

A golf ball according to the present invention may have a solid center, a wound layer surrounding the solid center, an intermediate layer surrounding the wound layer of thermoset material, and a multi-layer cover molded thereon.

In this example, the center includes a solid polybutadiene composition. The center was wound with a thread, LYCRA®, including polymerization spun polyether urea. The thread includes about 125 strands with diameters of about 0.0001 inches. The area of the thread is about 0.00017 $in^2$. The center and the windings have an outer diameter of about 1.56 inches. The thread is wound about the center at elongations to about 300 percent. The windings are then covered using a thermoset polybutadiene and trans-polyisoprene to form an intermediate layer. The inner and outer cover layers are formed following the processes as disclosed in U.S. Pat. No. 5,885,172. A particularly desired material for forming the outer cover layer is 40D castable urethane.

While it is apparent that the illustrative embodiments of the invention herein disclosed fulfills the objectives stated above, it will be appreciated that numerous modifications and other embodiments may be devised by those skilled in the art. For example, the smaller diameter thread used with the present invention could have strands of varying diameters. Therefore, it will be understood that the appended claims are intended to cover all such modifications and embodiments which come within the spirit and scope of the present invention.

What is claimed is:

1. A golf ball comprising:

a solid center;

at least one wound thread layer disposed about the center, wherein the thread is wound at an elongation of at least 100 percent or greater and comprises a plurality of individual strands;

an intermediate layer disposed about the at least one wound thread layer; and a cover.

2. The golf ball of claim 1, wherein the at least one wound thread layer is formed from a material comprising polyether urea, polyester urea, polyester block copolymers, polyethylene, polyamide, polyketon, poly(p-phenylene terephthalamide), or polyisoprene.

3. The golf ball of claim 2, further comprising an additional thread layer disposed about the at least one wound thread layer, wherein the additional thread layer comprises a single-ply or a two-ply thread.

4. The golf ball of claim 1, wherein the thread comprises about 10 individual strands or greater.

5. The golf ball of claim 4, wherein the thread comprises about 50 individual strands or greater.

6. The golf ball of claim 1, wherein the thread is wound at an elongation of at least about 200 percent.

7. The golf ball of claim 1, wherein the wound thread has an elastic modulus of about 20,000 psi to about 50,000 psi.

8. The golf ball of claim 1, wherein the at least one wound thread layer has a thickness of about 0.2 inches or less.

9. The golf ball of claim 1, wherein the intermediate layer comprises at least one thermoset material.

10. The golf ball of claim 9, wherein the at least one thermoset material comprises at least one of polybutadiene, natural rubber, polyisoprene, styrene-butadiene, or styrene-propylene-diene rubber.

11. The golf ball of claim 10, wherein the at least one thermoset material comprises trans-polyisoprene, trans-polybutadiene, or mixtures thereof.

12. The golf ball of claim 1, wherein the solid center comprises at least one of polybutadiene, natural rubber, polyisoprene, styrene-butadiene, or styrene-propylene-diene rubber.

13. The golf ball of claim 1, wherein the solid center has a diameter from about 1 inch to about 1.55 inches.

14. The golf ball of claim 1, wherein the cover layer comprises at least one of a castable reactive liquid material, thermoset urethane ionomer, thermoset urethane epoxy, or a mixture thereof.

15. The golf ball of claim 14, wherein the castable reactive liquid material is a thermoset material.

16. The golf ball of claim 15, wherein the thermoset material is a thermoset cast polyurethane.

17. A golf ball comprising:

a center;

a polymer thread wound layer about the center, wherein the thread comprises about 10 individual strands or greater;

an intermediate layer disposed about the polymer thread wound layer, wherein the intermediate layer has a thickness of about 0.15 inches or less; and a cover.

18. The golf ball of claim 17, wherein the polymer thread comprises at least one of polyether urea, polyester urea, polyester block copolymers, polyethylene, polyamide, polyketon, poly(p-phenylene terephthalamide), or polyisoprene.

19. The golf ball of claim 17, wherein the polymer thread is wound at an elongation of at least about 100 percent.

20. The golf ball of claim 17, wherein the wound polymer thread has an elastic modulus of about 20,000 psi to about 50,000 psi.

21. The golf ball of claim 17, wherein the polymer thread has a cross-sectional area of about 0.001 $in^2$ or less.

22. The golf ball of claim 21, wherein the polymer thread had a cross-sectional area of about 0.00001 $in^2$ or less.

23. The golf ball of claim 17, wherein the intermediate layer comprises at least one of polybutadiene, natural rubber, polyisoprene, styrene-butadiene, or styrene-propylene-diene rubber.

24. The golf ball of claim 17, wherein the center has a diameter of about 1 inch to about 1.55 inches and comprises at least one of polybutadiene, natural rubber, polyisoprene, styrene-butadiene, or styrene-propylene-diene rubber.

25. The golf ball of claim 17, wherein the cover layer comprises an inner cover layer and an outer cover layer.

26. The golf ball of claim 25, wherein the inner cover layer is formed of a material having a flexural modulus of about 65,000 psi or greater and the outer cover layer comprises at least one castable reactive liquid material.

27. A golf ball comprising:

a center;

a wound thread layer disposed about the center, wherein the thread comprises at least one polyether urea, polyester urea, polyester block copolymers, polyethylene, polyamide, polyketon, poly(p-phenylene terephthalamide), or polyisoprene;

an intermediate layer disposed about the wound thread layer; and a cover disposed about the intermediate layer.

28. The golf ball of claim 27, wherein the wound thread layer comprises strands having cross-sectional areas of less than about 0.001 $in^2$.

29. The golf ball of claim 27, wherein the thread is wound at an elongation of at least about 100 percent, has an elastic modulus in the wound state of about 20,000 psi to about 50,000 psi, or both.

30. The golf ball of claim 27, wherein the center and the intermediate layer comprise at least one of polybutadiene, natural rubber, polyisoprene, styrene-butadiene, styrene-propylene-diene rubber, or mixtures thereof.

31. The golf ball of claim 27, wherein the diameter of the center is about 1.2 inches to about 1.55 inches and the intermediate layer has a thickness of about 0.15 inches or less.

32. The golf ball of claim 27, wherein the cover comprises:

an inner cover layer comprising at least one material having a flexural modulus of about 65,000 psi or greater; and an outer cover layer disposed about the inner cover layer comprising at least one castable reactive liquid material.

33. The golf ball of claim 32, wherein the at least one castable reactive material is a thermoset cast polyurethane.

34. The golf ball of claim 32, wherein the at least one material has a flexural modulus of about 70,000 psi to about 120,000 psi.

35. The golf ball of claim 32, wherein the at least one material comprises an ionomer resin having a methacrylic acid content of about 19 percent.

36. The golf ball of claim 32, wherein the at least one castable reactive liquid material has a hardness of about 30 Shore D to about 60 Shore D and a thickness of about 0.05 inches or less.

* * * * *